US008778586B2

(12) United States Patent
Obara et al.

(10) Patent No.: US 8,778,586 B2
(45) **Date of Patent: *Jul. 15, 2014**

(54) TONER FOR ELECTROSTATIC LATENT IMAGE DEVELOPMENT

(75) Inventors: Shinya Obara, Tokyo (JP); Tatsuya Nagase, Tokyo (JP); Noboru Ueda, Tokyo (JP); Junya Onishi, Tokyo (JP); Tatsuya Fujisaki, Tokyo (JP); Kenshi Miyajima, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/528,401

(22) Filed: Jun. 20, 2012

(65) Prior Publication Data

US 2013/0004890 A1 Jan. 3, 2013

(30) Foreign Application Priority Data

Jun. 28, 2011 (JP) ..... 2011-142633

(51) Int. Cl.
*G03G 9/00* (2006.01)

(52) U.S. Cl.
USPC ..... 430/110.2; 430/109.3; 430/109.4

(58) Field of Classification Search
USPC ..... 430/109.3, 110.2, 109.4
See application file for complete search history.

(56) References Cited

U.S. PATENT DOCUMENTS

| | | | | |
|---|---|---|---|---|
| 2008/0280218 | A1* | 11/2008 | Sabu et al. | 430/48 |
| 2009/0011356 | A1* | 1/2009 | Tomita et al. | 430/109.4 |
| 2012/0264046 | A1* | 10/2012 | Onishi et al. | 430/109.3 |

FOREIGN PATENT DOCUMENTS

| | | | |
|---|---|---|---|
| JP | 2005-173202 | | 6/2005 |
| JP | 2005-221933 | | 8/2005 |
| JP | 2005-338548 | | 12/2005 |
| JP | 2011-028257 | | 2/2011 |
| JP | 2012027179 A | * | 2/2012 |

OTHER PUBLICATIONS

English Translation of JP-2012027179 Published Feb. 2012.*

* cited by examiner

*Primary Examiner* — Stewart Fraser
(74) *Attorney, Agent, or Firm* — Lucas & Mercanti, LLP

(57) ABSTRACT

A toner used for electrostatic latent image development which is excellent in fixing separability with maintaining sufficient low temperature fixability even in a high-speed machine and is also superior in crashing resistance, comprising toner particles, each comprising a core particle and a shell layer provided on the surface of the core particle, wherein the core particle comprises a binder resin containing a styrene-acrylic resin and a first styrene-acrylic modified polyester, and the shell comprises a second styrene-acrylic modified polyester resin.

7 Claims, No Drawings

TONER FOR ELECTROSTATIC LATENT IMAGE DEVELOPMENT

This application claims priority from Japanese Patent Application No. 2011-142633, filed on Jun. 28, 2011, which is incorporated hereinto by reference.

FIELD OF THE INVENTION

The present invention relates to a toner used for electrostatic latent image development (hereinafter, also denoted simply as a toner), and in particular to a toner used for electrostatic latent image development for use in an electrophotographic image forming apparatus.

BACKGROUND OF THE INVENTION

In the field of toners used for electrostatic latent image development during recent years, there has been rapidly advanced development of an electrophotographic apparatus responsible to meet the requirements of the market and a toner usable in the apparatus. For instance, in response to the requirement for high-quality imaging in the market there has; been required a toner with a narrow particle size distribution. Namely, a toner in which particle size becomes uniform and a narrow particle size distribution is achieved, results in markedly enhanced reproducibility of minute dots. However, it is not easy to achieve a narrow particle size distribution in the toner production method of the conventional pulverization processes.

On the other hand, there was proposed an emulsion aggregation process as a production method capable of controlling the shape or the particle size distribution, of toner particles. In such a process, an emulsified dispersion of resin particles is mixed with a colorant particle dispersion and optionally with a wax dispersion, and the respective particles are allowed to aggregate by addition of a coagulant or pH control with stirring and the thus aggregated particles are allowed to fuse by heating to obtain toner particles.

Further, there has been promoted development of a low temperature fixing toner capable of achieving fixing at a relatively low temperature with the object of energy savings. However, it is necessary to lower the melting temperature or melt viscosity of a binder resin to achieve a lowering of the fixing temperature of a toner. However, lowering the glass transition point or the molecular weight of a binder resin to lower the melting temperature or melt viscosity of the binder resin produced problems such as deterioration of heat storage stability or fixing separability.

There was also informed a technique of controlling a toner to a core/shell type structure to achieve both low temperature taxability and heat storage stability (as described in, for example, JP 2005-221933 A). Namely, a shell layer composed of a resin which exhibits a high softening point and enhanced heat resistance is formed on a core particle which is excellent in low temperature fixability, rendering it feasible to achieve both low temperature fixing and heat storage stability. Specifically, toner production by the emulsion aggregation process also has the advantage that shape control can be easily conducted. In recent production print areas, however, increased speed of a copier and a printer, and expansion of corresponding kinds of paper are promoted and it has become difficult to achieve both low temperature fixing and heat storage stability by the foregoing core/shell type toner.

To solve such a problem, there was developed a toner in which a polyester resin was used for a shell layer (as described in, for example, JP 2005-338548 A). A polyester resin has the advantage of low softening point design making it feasible to maintain a high glass transition point, as compared to styrene-acryl resin. A toner which is superior in low temperature fixing and heat storage stability can be obtained by use of a polyester resin for a shell layer.

However, a styrene-acryl resin and a polyester resin are low in affinity and when a styrene-acryl resin was used for a core and a polyester resin is used for a shell layer, it was difficult to form a uniform, thin shell layer, so that it was impossible to achieve sufficient heat storage stability. Further, there was a problem such that fusion of a core and a shell layer is also not feasible, rendering it difficult to control the shape of toner particles, so that it was difficult to prepare toner particles having homogeneous, close and smooth surfaces; cashing resistance was low and when performing continuous-printing, peeling of a shell layer occurs by stirring a toner within a copying machine, resulting in a large variation in electrostatic charge and causing image noises, leading to deteriorated image quality.

To solver the foregoing problems, there was proposed a toner of a core/shell structure, using a urethane-modified polyester resin and/or acryl-modified polyester resin (as described in, for example, JP 2005-173202 A). There was also disclosed a technique to improve low temperature fixing, offset property and humidity dependence of electrostatic charge by using a resin, as a toner resin, in which a radical polymer unit is linked to a polyester resin through a bivalent cross-linking group (as described in, for example, JP 2011-028257 A).

SUMMARY OF THE INVENTION

To improve affinity between a styrene-acryl resin and a polyester resin, a urethane-modified polyester resin or art acryl-modified polyester resin is used as a resin constituting a shell layer, whereby, even when, a styrene-acryl resin is used for a core, a shell layer can be formed to a certain extent. However, since no styrene component is present in the shell layer, the glass transition point of a resin of the shell layer is increased, impairing low temperature fixing capability. Accordingly, lowering the softening point of a core resin to enhance low temperature fixing capability resulted in deteriorated fixing separability, so that it was insufficient to achieve compatibility of low temperature fixability and fixing separability, or that, of crushing resistance and electrostatic charging property.

The present invention has come into being to solve, the foregoing problems and it is an object of the present invention to provide a toner used for electrostatic latent image development in which a thin uniform layer is provided on the core particle surface and which is excellent, in fixing separability with maintaining sufficient low temperature fixability even, in a high-speed machine used in a production print area and is also superior in crushing resistance, leading to excellent electrostatic-charging property.

The foregoing object of the present invention can be solved by the following constitution.

1. A toner used for electrostatic latent image development, comprising toner particles, each comprising a core particle and a shell layer provided on the surface of the core particle, wherein Sire core particle comprises a binder resin containing a styrene-acrylic resin and a first styrene-acrylic modified polyester, and the shell comprises a second styrene-acrylic modified polyester resin.

2. The toner, as described in 1, wherein the binder resin of the core particle contains the first styrene-acrylic modified polyester resin in an amount of not less than 5% by mass and not more than 30% by mass.

3. The toner, as described in 1 or 2, wherein the first styrene-acrylic modified polyester resin or the second styrene-acrylic modified polyester resin contains a styrene-acrylic resin segment of not less than 5% by mass and not more than 30% by mass.

4. The toner, as described in any of 1 to 3, wherein a structure unit derived from a polyvalent carboxylic acid monomer to form a polyester segment of the styrene-acrylic modified polyester resin contains a structure unit derived from an aliphatic unsaturated dicarboxylic acid of not less than 25 mol % and not more than 75 mol %.

5. The toner, as described in 4, wherein the aliphatic unsaturated dicarboxylic acid is represented by the following formula (A):

$$HOOC—(CR_1=CR_2)_n—COOH \quad \text{formula (A)}$$

wherein $R_1$ and $R_2$, which may be the same or different, are each a hydrogen atom, a methyl group or an ethyl group; and n is an integer of 1 or 2.

6. The toner, as described in any of 1 to 5, wherein the first styrene-acrylic modified polyester or the second styrene-acrylic modified polyester is obtained by a process comprising:

polymerizing an aromatic vinyl monomer and a (meth) acrylate monomer to form a styrene-acrylic polymer segment of the styrene-acrylic modified polyester resin in the presence of an unmodified polyester resin and a di-reactive monomer containing a group capable of reacting with a polyvalent carboxylic acid monomer or a polyvalent alcohol monomer and a polymerizable unsaturated group.

A toner for electrostatic latent image development, which is excellent in low temperature friability and fixing separability and also superior in crushing resistance and electrostatic-charging stability, can be obtained by the foregoing constitution.

EMBODIMENTS OF THE INVENTION

In the following, embodiments of the present invention will be described in detail, but the present invention is by no means limited to these.

The present invention, is related to a toner for electrostatic latent image development and comprising toner particles, in particular to a toner comprising toner particles having a core/shell structure comprising a core particle and a shell provided on the core particle, and in more particular to a toner comprising toner particles having a core/shell structure comprising a core particle and a shell layer provided on the core particle, in which the core particle comprises a binder resin containing a styrene-acrylic resin and a first styrene-acrylic modified polyester, and the shell comprises a second styrene-acrylic modified polyester resin.

The shell layer of toner particles of the toner for electrostatic latent image development of the present invention uses a styrene-acrylic modified, polyester resin. The use of such a styrene-acrylic modified polyester resin is based on the following reason. Namely, an advantage of a polyester resin as a loner resin is that the design of a low softening point is feasible with maintaining a relatively high glass transition point, compared to a styrene-acrylic resin. Consequently, such a polyester resin is a preferable resin capable of achieving compatibility of both low temperature fixability and fixing separability. However, as described earlier, a polyester resin constituting a shell layer is poor in affinity for a styrene-acrylic resin used as a main component of a core particle, so that it is difficult to form a thin, uniform shell layer. Further, such toner particles have a problem such that the shell layer is a brittle film and easily crushed. Specifically, when toner particles are subject to stress such as stirring within a developing device, a shell layer film is easily stripped. Accordingly, when printing is conducted over a long duration, the electrostatic charge becomes unstable, causing image staining such as togging. So, a polyester resin used in a shell layer is replaced by a styrene-acrylic modified polyester resin in which a styrene-acrylic resin is bonded to a polyester resin, resulting in enhanced affinity to a styrene-acrylic resin of a core particle, while maintaining a high glass transition point and a low softening point of a polyester resin, making it feasible to form a thin, uniform and smooth shell layer and thereby, enhanced crushing resistance is achieved, leading to enhanced electrostatic charge stability.

A combination of a styrene-acrylic resin and a styrene-acrylic modified polyester resin is used for a binder resin constituting a core particle, whereby low temperature fixability and fixing separability become compatible.

Namely, a polyester resin exhibits a relatively high glass transition point, white maintaining a high sham-melting property. Accordingly, it melts instantaneously at the lime of fixing and permeates into a recording medium such as paper, enabling to provide strong fixability. The use of such a styrene-acrylic modified polyester resin makes it possible to achieve further enhanced low temperature fixing capability.

The use of a styrene-acrylic modified polyester resin in both a core particle and a shell layer makes it feasible to set a relatively high value for a softening point of a styrene-acrylic resin used in the core particle. As a result, elasticity of the core particle is increased, making it possible to achieve enhanced fixing separability of toner particles. Further, formation of a thin, uniform shell layer becomes possible, leading to enhanced crushing resistance of toner particles and resulting in stabilization of electrostatic charge, making it possible to obtain a toner resistant to image staining and of high, image quality.

Accordingly, it becomes possible to achieve a good balance between conflicting performances of low temperature fixing capability and fixing separability, making it feasible to obtain a toner for electrostatic latent image development which is excellent in low temperature fixability and fixing separability and also superior in crashing resistance, and electrostatic-charging stability.

Styrene-Acrylic Modified Polyester Resin:

In the following, there will be described a styrene-acrylic modified polyester resin used for a binder resin of a core particle and a shell layer. In a styrene-acrylic modified polyester resin used in the present invention, the content of a styrene-acrylic polymer segment (which is also denoted as a styrene-acrylic modification amount) is preferably not less than 5% by mass and not more man 30% by mass, and more preferably not less than 5% by mass and not more than 20% by mass.

Specifically, the styrene-acrylic modification amount refers to a ratio of amass of an aromatic vinyl monomer and a (meth)acrylate monomer to a total mass of resin materials used for synthesis of a styrene-acrylic modified polyester resin, that is, the total mass of polymerizable monomers forming an unmodified polyester resin constituting a polyester segment, an aromatic vinyl monomer forming an acrylate monomer and a reactive monomer to allow these to be bonded.

When the styrene-acrylic modification amount falls with the foregoing range, affinity of a styrene-acrylic modified polyester resin to a core particle is appropriately controlled, making it possible to form a thin, smooth shell layer of a uniform thickness. On the other hand, when the styrene-acrylic modification amount is excessively small, a shell layer of a uniform thickness can not be formed and a core particle is partially exposed, making it difficult to attain sufficient heat storage stability and electrostatic-charging performance. Further, when the styrene-acrylic modification amount is excessively large, the softening point of a styrene-acrylic modified polyester resin rises, making it difficult to attain sufficient low-temperature fixing capability, as a whole of toner particles.

In the toner of the present invention, there is used an unsaturated aliphatic dicarboxylic acid as a polyvalent carboxylic acid monomer to form a polyester segment of a styrene-acrylic modified polyester resin, and it is preferred feat a structural unit derived from said unsaturated aliphatic dicarboxylic acid is contained in the polyester segment. Such an unsaturated aliphatic dicarboxylic acid refers to a dicarboxylic acid containing a vinyl group in the molecule.

The use of a styrene-acrylic modified polyester resin having a structural unit derived from an unsaturated aliphatic dicarboxylic acid for a shell layer makes it possible to form a thin, smooth shell layer of uniform thickness. Further it is presumed feat, when such a styrene-acrylic modified polyester resin having a structural unit derived from an unsaturated aliphatic dicarboxylic acid is contained in a core particle, the presence of a straight chain structure in the molecule results in enhanced affinity to wax, whereby incorporation of wax into a core particle is enhanced, making it possible to maintain smoothness of the surface.

In the structural unit derived from a polyvalent carboxylic acid monomer constituting a polyester segment of such a styrene-acrylic modified polyester resin, the content percentage of a structural unit derived from an unsaturated aliphatic dicarboxylic acid (which is hereinafter also denoted as a specific unsaturated dicarboxylic acid content percentage) is preferably not less than 25 mol % and not less than 75 mol %, and more preferably, not less than 30 mmol % and not less than 60 mol %.

When the specific unsaturated dicarboxylic acid content percentage fails within the foregoing range, a thin, smooth shell layer of a uniform thickness can be formed more definitely. On the other hand, when the specific unsaturated dicarboxylic acid content percentage is excessively small, sufficient heat storage stability and electrostatic-charging performance sometimes cannot be achieved. On the contrary, when the specific unsaturated dicarboxylic acid content percentage is excessively large, sufficient electrostatic-charging performance sometimes cannot be achieved.

The structural unit derived from an aliphatic unsaturated dicarboxylic acid preferably is a structural unit derived from a compound represented by the following formula (A):

$$HOOC—(CR_1{=}CR_2)_n—COOH \qquad \text{Formula (A)}$$

wherein $R_1$ and $R_2$ are each a hydrogen atom, a methyl group or an ethyl group, which may be the same or different; n is an integer of 1 or 2.

When such a structural mat derived from an aliphatic unsaturated dicarboxylic acid is contained, a thin, smooth shell layer of a uniform thickness can be formed more definitely. In the present invention, an aliphatic unsaturated dicarboxylic acid represented by the formula (A) may be used in the form of an anhydride in a polymerization reaction.

Namely, a polyester resin generally exhibits hydrophobicity and when preparing toner particles by a process of emulsion aggregation, polyester resin particles are aggregated together in the presence of core particles comprised of a styrene-acrylic resin, causing so-called homo-aggregation. However, when a carbon-carbon double bond exists in the polyester molecule, hydrophilicity of the polyester resin increases, making it difficult to cause homogeneous aggregation. Further, an increase of hydrophilicity of the polyester resin promotes such an effect that polyester resin segments are oriented to the external side to a core panicle, that is, toward the aqueous medium side when preparing toner particles in an aqueous medium by a process of emulsion aggregation, whereby formation of a thin, uniform and close shell layer becomes feasible.

Accordingly, as described earlier, it is assumed mat, when a resin to form a shell layer is constituted of a styrene-acrylic modified polyester resin, a styrene-acryl component of the styrene-acrylic modified polyester resin orients itself to the core particle surface, while maintaining affinity to a styrene-acrylic resin constituting the core and formation of a thin, uniform and close shell layer becomes possible through a hydrophilizing effect by a carbon-carbon double bond of a polyester resin segment.

When a styrene-acrylic modified polyester resin of the present invention is used for a shell layer, its glass transition temperature preferably is 50 to 70° C. (more preferably 50 to 65° C.) and a softening point, of 80 to 110° C. When it is used for a binder resin of a core particle, the glass transition temperature is preferably from 40 to 60° C. and softening point is preferably from 80 110° C.

The glass transition temperature of a styrene-acrylic modified polyester resin is a value determined in accordance with the method (also denoted as DSC method) defined in ASTM (American Standard for Testing and Materials) standard D 3418-82.

Specifically, 4.5 mg of a sample is precisely weighed to two places of decimals, sealed into an aluminum pan and set into a sample holder of a differential scanning colorimeter DSC 8500 (made by Perkin Elmer Corp). An empty aluminum pan is used as a reference. The temperature is controlled through heating-cooling-heating at a temperature-rising rate of 10° C./min and a temperature-lowering rate of 10° C./min in the range of 0 to 120° C. An extension line from the base-line prior to the initial rise of the first endothermic peak and a tangent line exhibiting the maximum slope between the initial rise and the peak are drawn and the intersection of both lines is defined as the glass transition point.

The softening temperature of a styrene-acrylic modified polyester resin can be determined in the following manner. Under an environment of 20±1° C. and 50±5% RH, 1.1 g of the resin is placed into a petri dish and leveled off. After being allowed to stand for at least 12 hrs., they are compressed for 30 sec. under a force of 3820 kg/cm$^2$ using a molding device SSP-10A (made by Shimazu Seisakusho) to prepare a cylindrical molded sample of a 1 cm diameter. Using a flow tester CFT-500D (made by Shimazu Seisakusho) under an environment of 24±5° C. and 50*20%, the prepared sample is extruded through a cylindrical die (1 mm diameter×1 mm) using a piston of 1 cm diameter after completion of preheating under conditions of a load weight, of 196 N (20 kgf), at an initial temperature of 60° C., a pre-heating time of 300 sec. and temperature-raising rate of 6° C./min. An offset method temperature (also denoted as $T_{offset}$), which is determined at an offset value of 5 mm in a melting temperature measurement method (temperature-raising method), is defined as the softening point in the invention. The refers to the temperature determined in the offset method.

The content of a shell resin is preferably from 5 to 50% by mass of the total amount of binder resins constituting a toner particle, and more preferably from 10 to 40% by mass.

When the content of a shell resin is excessively low, mere is a concern that sufficient heat storage stability cans not be achieved; and when the content of a shell resin is excessively high, there is a concern that adequate low temperature fixability can not be achieved.

Production of Styrene-Acrylic Modified Polyester Resin;

The styrene-acrylic modified polyester of the present invention is obtained by the method comprising:

polymerizing an aromatic vinyl monomer and a (meth) acrylate monomer in the presence of an unmodified polyester resin and a di-reactive monomer containing a group capable of reacting with a polyvalent carboxylic acid monomer or a polyvalent alcohol monomer and a polymerizable unsaturated group, in which the aromatic vinyl monomer, the (meth) acrylate monomer and the di-reactive monomer form a styrene-acrylic polymer segment of the styrene-acrylic modified polyester resin.

There can be employed generally known schemes as a method for preparing a styrene-acrylic modified polyester resin. Representative methods include four methods as described below:

(A) A method in which a polyester segment is previously formed through polymerisation, a di-reactive monomer is allowed to react with the polyester segment, and an aromatic vinyl monomer and a (meth)acrylate monomer to form a styrene-acrylic polymer are further allowed to read to form a styrene-acrylic polymer segment;

(B) A method in which a styrene-acrylic polymer segment is previously formed through polymerization, a directive monomer is allowed to react with the styrene-acrylic polymer segment, and a polyvalent carboxylic acid monomer and a polyvalent alcoholic monomer are allowed to react to form a polyester segment;

(C) A polyester segment and a styrene-acrylic polymer segment are previously formed, through polymerization and then, a direactive monomer is allowed to react to combine both segments;

(D) A polyester segment is previously formed through polymerization, and a polymerizable styrene-acrylic monomer is allowed to react with a polymerizable unsaturated group of the polyester segment through addition polymerization or to react with a vinyl group of a styrene-acrylic polymer segment to combine both.

In the present invention, the direactive monomer refers to a monomer containing a group which is capable of reacting with a polyvalent carboxylic acid monomer and/or a polyvalent alcoholic monomer to form a polyester segment of a styrene-acrylic modified polyester resin, and a polymerizable unsaturated group.

In the foregoing method (A), a styrene-acrylic polymer segment can be formed at the end of a polyester segment through mixing step (1) of mixing an unmodified polyester resin, an aromatic vinyl monomer, a (meth)acrylate monomer and a direactive monomer, and polymerization step (2) of allowing an aromatic vinyl monomer and a (meth)acrylate monomer to polymerize. In that ease, a hydroxyl group at the end of the polyester segment and a carboxyl group of the direactive monomer react with each other to form an ester bonding and a vinyl group of the direactive monomer is bonded to the aromatic vinyl monomer or a vinyl group of the (meth)acrylic monomer are combined, whereby the styrene-acrylic polymer segment is bonded. In the foregoing methods, the method (A) is more preferred.

In this method, it is assumed that a styrene-acrylic polymer segment can be attached to the end of a chain polyester segment, the styrene-acrylic polymer segment is oriented with maintaining affinity for a styrene-acrylic resin of a core particle and the polyester segment is exposed on the toner surface to form a toner of a core/shell structure with a thin, uniform shell layer.

In the mixing step (1), it is preferred to conduct heating. The heating temperature may fall within any range in which an unmodified polyester resin, an aromatic vinyl monomer, a (meth)acrylate monomer and a direactive monomer can be mixed, and preferably is, for example, from 80 to 120° C. and more preferably from 85 to 115° C., and still more preferably from 90 to 110° C. in terms of achieving favorable mixing and easier control of polymerization.

Of an unmodified polyester resin, an aromatic vinyl monomer, a (meth)acrylate monomer and a direactive monomer, the proportion of both of an aromatic vinyl monomer and a (meth)acrylate monomer is preferably not less than 5% by mass and not more man 30% by mass, and more preferably not less than 5% by mass and not more than 20%, provided that the total mass of resin material used, that is, the total mass of the foregoing four compounds is 100%.

When the proportion of the total of an aromatic vinyl monomer and a (meth)acrylate monomer falls within the foregoing range, affinity of a styrene-acrylic modified polyester resin to a core particle is appropriately controlled to form, whereby a shell layer with a thin and uniform thickness and a smooth surface. On the other hand, when the said proportion is excessively small, the produced styrene-acrylic modified polyester resin can not form a shell layer of uniform thickness and a core particle is partially exposed, making it difficult to achieve sufficient heat storage stability and electrostatic-charging capability. Further, when the said proportion is excessively large, the softening point of the obtained styrene-acrylic modified polyester resin is increased, making it difficult to obtain a toner with sufficient low-temperature fixability.

The proportion of an aromatic vinyl monomer and a (meth) acrylate monomer preferably is one in which the glass transition point (Tg) calculated from the FOX equation represented by the following equation (i) falls within a range of 35 to 80° C., and preferably 40 to 60° C.:

$$1/Tg=\Sigma(Wx/Tgx) \quad \text{(i)}$$

where Wx is the weight fraction of a monomer x and Tgx is the glass transition temperature of a homopolymer of the monomer x.

In the present invention, both reactive monomers are not used in the foregoing calculation of glass transition point.

Of an unmodified polyester resin, an aromatic vinyl monomer, a (meth)acrylate monomer and a direactive monomer, the proportion of a direactive monomer is preferably not less than 0.1% by mass and not more than 5.0% by mass, and more preferably not less than 0.5% by mass and not more than 3.0%, based on the total mass of resin material used, that is, the total mass of the foregoing four compounds being 100%.

Aromatic Vinyl Monomer and (Meth)Acrylate Monomer:

An aromatic vinyl monomer and a (meth)acrylate monomer to form a styrene-acrylic polymer segment, each contains an ethylenically unsaturated bond capable of performing radical polymerization.

Specific examples of an aromatic vinyl monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene. These aromatic vinyl monomers may be used singly or in their combination.

Specific examples of a (meth)acrylate monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate. These (meth)acrylate monomers may be used singly or in their combination.

Of aromatic vinyl monomers and (meth)acrylate monomers to form a styrene-acrylic polymer segment, styrene or its derivative preferably is used to achieve superior electrostatic-charging property and image quality characteristic. Specifically, styrene or its derivative preferably account for at least 50% by mass of all of monomers used for formation of a styrene-acrylic polymer segment, that is, aromatic vinyl monomers and (meth)acrylate monomers.

Direactive Monomer:

A direactive monomer to form a styrene-acrylic polymer segment may be a monomer containing a polymerizable unsaturated group and a group capable of reacting with a polyvalent carboxylic acid monomer and/or a polyvalent alcoholic monomer to form a polyester segment. Specific examples of such a direactive monomer include acrylic acid, methacrylic acid, fumaric acid, maleic acid and maleic anhydride. In the present invention, acrylic acid or methacrylic acid is preferred as a direactive monomer.

Polyester Resin:

A polyester resin used to prepare a styrene-acrylic modified polyester resin related to the present invention is one which is produced through a polycondensation reaction in the presence of an appropriate catalyst by using, as raw materials, a polyvalent carboxylic acid monomer (or its derivatives) and a polyvalent alcohol monomer (or its derivatives).

Such a polyvalent carboxylic acid monomer derivative can employ an alkyl ester, an acid anhydride or an acid chloride of a polyvalent carboxylic acid and a polyvalent alcohol monomer derivative can employ an ester compound of a polyvalent alcoholic monomer and a hydroxycarboxylic acid.

Specific examples of a polyvalent carboxylic acid monomer include divalent carboxylic acid such as oxalic acid, succinic acid, maleic acid, adipic acid, β-methyl adipic acid, azelaic acid, sebacic acid, nonanedicarboxylic acid, decanedicarboxylic acid, undecanadicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylene-diacetic acid, m-phenylene-di-glycolic acid, p-phenylene-di-glycolic acid, o-phenylene-di-glycolic acid, diphenylacetic acid, diphenyl-p,p'-dicarboxylic acid, naphthalene-1,4-dicarboxylic acid, napthalene-1,5-dicarboxylic acid, naphthalene-2,6-dicarboxylic acid, anthracene-dicarboxylic acid, dodecenylsuccinic acid; and di or more valent carboxylic acid such as trimellitic acid, pyromellitic acid, naphthalene tricarboxylic acid, naphthalene tetracarboxylic acid, pyrene-tricarboxylic acid, and pyrene-tetracarboxylic acid.

An aliphatic unsaturated dicarboxylic acid such as fumaric acid, maleic acid or mesaconic acid is usable as a polyvalent carboxylic acid monomer, and it is preferred to use an aliphatic unsaturated dicarboxylic acid represented by the formula (A), as described earlier. In the present invention, it is preferred to use a dicarboxylic acid anhydride, such as maleic acid anhydride.

A styrene-acrylic modified polyester resin obtained by use of an aliphatic unsaturated dicarboxylic acid certainly renders it feasible to form a thin and smooth shell layer with a uniform thickness. Specifically, the use of an unsaturated aliphatic di-carboxylic acid represented by the foregoing formula (A) makes it feasible that the obtained styrene-acrylic modified polyester resin securely forms a thin, uniform and smooth shell layer.

The proportion of an aliphatic unsaturated dicarboxylic acid is preferably not less than 25 mol % and not more than 75 mol % of all of polyvalent carboxylic acid monomers, and more preferably not less titan 30 mol % and not more than 60 mol %. The use of a styrene-acrylic modified polyester resin obtained when the proportion of an aliphatic unsaturated dicarboxylic acid falls within the foregoing range makes it possible to form a thin and smooth shell layer with a uniform thickness. On the other hand, when the proportion of an aliphatic unsaturated dicarboxylic acid is excessively small, foe obtained toner sometimes cannot achieve sufficient heat storage stability and electrostatic-charging property and when the proportion of an aliphatic unsaturated dicarboxylic acid is excessively large, sufficient electrostatic-charging property can at times not be achieved in the obtained toner.

Specific examples of a polyvalent alcoholic monomer include divalent alcohols such as ethylene glycol, propylene glycol, butanediol, diethylene glycol, hexanediol, cyclohexanediol, octanediol, decanediol, dodecanediol, and bisphenol A; and three or more valent polyols such as glycerin, pentaerythritol, hexamethylol melamine, hexaethylol melamine, and tetramethylol benzoguanamine.

With respect to the ratio of the polyvalent alcohol monomer to a polyvalent carboxylic acid monomer, an equivalent weight ratio [OH]/{COOH} of a hydroxyl group (OH) of a polyvalent alcohol to a carboxyl group (COOH) of a polyvalent carboxylic acid is preferably from 1.5/1 to 1/1.5, and more preferably, from 1.2/1 to 1/1.2.

A catalyst used for synthesis of a polyester resin may use various catalysts known in the art.

An unmodified polyester resin to obtain a styrene-acrylic modified polyester resin preferably exhibits a glass transition point of not less than 40° C. and not more than 70° C., and more preferably, not less than 50° C. and not more titan 65° C. When the glass transition point of an unmodified polyester resin is not less than 40° C., the aggregation force in a high temperature range of foe polyester resin becomes an appropriate one, which inhibits offset caused during fixing. Further, when foe glass transition point of an unmodified polyester resin is not more than 70° C., sufficient fusion is achieved in fixing, whereby a sufficiently lowest fixing temperature can be attained.

The weight average molecular weight (Mw) of said unmodified polyester resin is preferably not less than 1,500 and not more than 60,000, and more preferably not less man 3,000 and not more than 40,000.

When the weight average molecular weight is not less than 1,500, the whole of a binder resin can achieve an appropriate aggregation force. Further, when the weight average molecular weight, is not more than 60,000, occurrence of an offset phenomenon at the time of fixing is inhibited, while sufficient melting can be achieved and thereby, a sufficient minimum-fixing temperature can be attained.

In said unmodified polyester resin, a partially branched or cross-linked structure may be formed by choosing a carboxylic acid valence or alcoholic valence as a polyvalent carboxylic acid monomer and/or a polyvalent alcoholic monomer.

Polymerization Initiator:

In the afore-described polymerization step of allowing an aromatic vinyl monomer and a (meth)acrylate monomer, polymerization is performed preferably in the presence of a radical polymerization initiator. The timing for addition of a radical polymerization initiator is not specifically restricted but addition after a mixing step is preferred in terms of easy control of radical polymerization.

There are usable commonly known, various polymerization initiators and specific examples thereof include peroxides such as hydrogen peroxide, acetyl peroxide, cumyl peroxide, tert-butyl peroxide, propenyl peroxide, benzoyl peroxide, chlorobenzoyl peroxide, dichlorobenzoyl peroxide, bromomethylbenzoyl peroxide, lauroyl peroxide, ammonium, persulfate, sodium persulfate, potassium persulfate, diisopropyl peroxycarbonate, tetralin hydroperoxide, 1-phenyl-2-methylpropyl-1-hydroperoxide, per-triphenylacetic acid-tert-hydroperoxide, tert-butyl performate, tert-butyl peracetate, tert-butyl perbenzoate, tert-butyl perphenylacetic acid, tert-butyl permethoxyacetic acid, tert-butyl N-(toluoyl) palmitic peracid; and azo compounds such as 2,2'-azobis(2-aminodipropane)hydrochloride, 2,2'azobis-(2-aminodipropane) nitrate, 1,1'-azobis(sodium 1-methylbutylonitrile-sulfonate), 4,4'-azobis-4-cyanovaleric acid and poly (tetraethylene-glycol-2,2'-azobisisobutylate).

Chain Transfer Agent:

in the polarization step of allowing an aromatic vinyl monomer and a (meth)acrylate monomer described above to polymerize, there are usable commonly known chain transfer agents to control the molecular weight of a styrene-acrylic polymer segment. Such chain transfer agents ere not specifically limited, and examples thereof include an alkylmercaptan, a mercapto-fatty acid ester and the like.

A chain transfer agent is preferably mixed with resin materials in the mixing step described The addition amount of a chain transfer agent, which depends on the molecular weight or molecular weight distribution of an intended styrene-acrylic polymer segment, is preferably from 0.1 to 5% by mass of the total amount of an aromatic vinyl monomer, a (meth)acrylate monomer and a direactive monomer.

The polymerization temperature in the polymerization step of allowing the foregoing aromatic vinyl monomer and acrylate monomer is not specifically limited hut is appropriately chosen within a range in which polymerization between an aromatic vinyl monomer and a (meth)acrylate monomer and bonding to a polyester resin can proceed. The polymerization temperature is preferably within a range of not less than 85° C. and not more titan 125° C., more preferably not less than 90° C. and not more than 120° C., and still more preferably not less than 95° C. and not more than 115° C.

In the production of a styrene-acrylic modified polyester resin, it is practically preferable to limit the amount of volatile organic substances from emulsified materials such as residual monomers after the polymerization step to not more than 1,000 ppm, preferably not more than 500 ppm, and more preferably not more than 200 ppm.

Shell Layer:

The shell layer constituting the toner particle related to the present invention is comprised of a shell resin containing the afore-described styrene-acrylic modified polyester resin.

Examples of a resin contained together with the styrene-acrylic modified polyester resin in the shell resin include a styrene-acryl resin, a polyester resin and a polyurethane resin.

The content of a styrene-acrylic modified polyester resin in a shell resin preferably is from 70 to 100% by mass of 100% by mass of the shell resin, and more preferably form 90 to 100% by mass.

When the content of a styrene-acrylic modified polyester resin in a shell resin is less than 70% by mass, sufficient affinity of a core particle with the shell layer cannot be achieved, rendering it difficult to form an intended shell layer and there is a concern that sufficient heat storage stability and sufficient electrostatic-charging or crushing strength cannot be achieved.

The use of a styrene-acrylic modified polyester resin in a shell resin constituting toner particles can achieve advantageous effects, as described below.

Namely, an advantage of using a polyester resin as a binder resin in the design of toner particles resides in fire fact that the design for lowering the softening point is feasible, while the polyester resin maintains a high glass transition point (Tg), compared to a styrene-acrylic resin. That is, a polyester resin is a suitable resin satisfying both low temperature fixability and heat, storage stability. Further, introduction of a styrene-acrylic polymer segment to a polyester resin used in a shell layer results in enhanced affinity with a styrene-acrylic resin, while maintaining a high glass transition point and a low softening point of the polyester resin, making it possible to form a shell layer of a thin and uniform thickness and a smooth surface. Accordingly, the toner of the present invention satisfies both low temperature fixability and heat storage stability and also achieves excellent electrostatic-charging capability. Further, the shell layer becomes difficult to be peeled, whereby sufficiently enhanced crushing resistance in which no crushing is caused even when subject to stress with being stirred within a developing device, is achieved, rendering it feasible to obtain images of no image noise and enhanced image quality.

Core Particle:

In the present invention, a core particle contains at least a binder resin and may contain a colorant, wax (also denoted as a releasing agent) and a charge-controlling agent as needed, and the binder resin constituting the core particle contains a styrene-acrylic resin and a styrene-acrylic modified polyester resin. A styrene-acrylic modified polyester resin is contained preferably in amount of 5 to 30% by mass of the total amount of the binder resin. Such an amount falling within this range makes it feasible to achieve both low temperature fixability and fixing separation capability.

Styrene-Acrylic Modified Polyester Resin:

A styrene-acrylic modified polyester rosin constituting a rare particle employs the one described earlier.

Styrene-Acrylic Resin:

Polymerizable monomers to form a styrene-acrylic resin constituting a core particle related to the present invention are an aromatic vinyl monomer and a (meth)acrylate monomer, and preferably are those which contain an ethylenically unsaturated bond capable of performing radical polymerization. Specific examples thereof include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dimethylstyrene, 3,4-dichlorostyrene, and their derivatives. These aromatic vinyl monomers may be used singly or in their combination.

Specific examples of a (meth)acrylate monomer include methyl acrylate, ethyl acrylate, butyl acrylate, 2-ethylhexyl acrylate, cyclohexyl acrylate, phenyl acrylate, methyl methacrylate, ethyl methacrylate, butyl v, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate. These (meth)acrylate monomers may be used singly or in their combination. Of the foregoing monomers, the combined use of a styrenic monomer, an acrylate monomer and a methacrylate monomer is preferred.

There may be used a third vinyl monomer as a polymerizable monomer. Examples of the third monomer include an acid monomer such as acrylic acid, methacrylic acid, and maleic acid anhydride; vinyl acetic acid, acrylamide, methacrylamide, acrylonitrile, ethylene, propylene, butylene, vinyl chloride, N-vinylpyrrolidone and butadiene.

There may be used a poly-functional vinyl monomer as a polymerizable monomer. Examples of such a poly-functional vinyl monomer include a diacrylate of ethylene glycol, propylene glycol, butylene glycol or hexylene glycol; divinylbenzene, and a dimethacrylate or a trimethacrylate of a tertiary or higher alcohol. The copolymerization ratio of a poly-functional vinyl monomer to total polymerizable monomers is preferably from 0.001 to 5% by mass, more preferably from 0.003 to 2% by mass, and still more preferably from 0.01 to 1% by mass. The use of such a poly-functional vinyl monomer results in formation of a gel component, insoluble in tetrahydrofuran but the proportion of such a gel component is usually not more than 40% of the whole of polymers, and preferably not more than 20% by mass.

A binder resin constituting a core particle and comprising a styrene-acrylic resin and a styrene-acrylic modified polyester resin preferably exhibits a glass transition point (Tg) of 40 to 60° C.

Further, a binder resin constituting a core particle preferably exhibits a softening point of 80 to 110° C. Mien foe glass transition point and softening point of a binder resin constituting a core particle fall within foe foregoing ranges, foe viscosity and elasticity of a toner respectively fall within preferable ranges, making it possible to satisfy both low temperature fixability and fixing separability.

The glass transition point (Tg) and softening point of a binder resin constituting a core particle can be determined in the same manner as the measurement method of a styrene-acrylic modified polyester resin, as described earlier.

Production Method of Styrene-Acrylic Resin:

A styrene-acrylic resin constituting foe core particle of the present invention is prepared preferably by an emulsion polymerization method. Such an emulsion polymerization method is carried out by dispersing polymerizable monomer's of styrene and an acrylate in an aqueous medium and allowing the monomers to polymerize. It is preferred to use a surfactant to disperse the polymerizable monomers in the aqueous medium, and there may be used a polymerization initiator or a chain transfer agent in polymerization.

Polymerization Initiator:

A polymerization initiator used for polymerization of a styrene-acrylic resin is not specifically limited and commonly known initiators are usable. For instance, there are usable polymerization initiators used for polymerization of the styrene-acrylic polymer segment of a styrene-acrylic modified polyester resin, as described earlier. There is preferably used, air aqueous-soluble polymerization initiator, as a polymerization initiator used for polymerization. Specific examples of such a polymerization initiator include peroxides such as hydrogen peroxide, acetyl peroxide, cumyl peroxide, tert-butyl peroxide, propenyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, per-triphenylacetic acid-tert-hydroperoxide, tert-butyl performate, tert-butyl peracetate, tert-butyl perbenzoate, tert-butyl perphenylacetic acid, tert-butyl permethoxyacetic acid, tert-butyl N-(toluyl)palmitic peracid; and azo compounds such as 2,2'-azobis(2-aminodipropane) hydrochloride, 2,2'azobis-(2-aminodipropane) nitrate, 1,1'-azobis(sodium 1-methylbutylonitrile-sulfonate), 4,4'-azobis-4-cyanovaleric acid and poly(tetraethylene-glycol-2,2'-azobisisobutylate).

Chain Transfer Agent:

There may be added a chain transfer agent together with the foregoing polymerizable monomers in the production of the styrene-acrylic resin of the present invention. Addition of a chain transfer agent makes it feasible to control the molecular weight of a polymer. A chain transfer agent may employ a commonly known one, such as a chain transfer agent, for use in polymerization of the styrene-acrylic polymer segment of a styrene-acrylic modified polyester resin, as described earlier, and specific examples of such a chain transfer agent include an alkylmercaptan and a mercapto-fatty acid ester. An addition amount of a chain transfer agent, which depends on the desired molecular weight, or molecular weight distribution, is preferably within a range of 0.1 to 5.0% by mass of a polymerizable monomer.

Surfactant:

When dispersing a styrene-acrylic resin in an aqueous medium and subjecting it polymerization through emulsion polymerization, a dispersion stabilizer is usually added thereto to prevent aggregation of dispersed, droplets. Such a dispersing agent may employ commonly known surfactants and there may be used a surfactant chosen from a canonic surfactant, an anionic surfactant and a nonionic surfactant. Such surfactants may be used singly or in their combination. Further, a surfactant may be used in a dispersion of a colorant, an offset inhibitor or the like.

Specific examples of a cationic surfactant include dodecylammonium bromide, dodecytrimethylammonium bromide, dodecylpyridinium chloride, dodecylpyridinium bromide, and hexadecyltrimethyl ammonium bromide.

Specific examples of a nonionic surfactant include polyoxyethylene dodecyl ether, polyoxyethylene hexadecyl ether, polyoxyethylene nonylphenyl ether, polyoxyethylene lauryl ether, polyoxyethylene sorbitan monooleate ether, polyoxyethylene styrylphenyl ether, and monodecanoyl saccharose.

Specific examples of an anionic surfactant include an aliphatic soap such as sodium stearate or sodium laurate, sodium laurylsulfate, sodium dodecylbenzene sulfonate, and polyoxyethylene (2) layryl ether sodium sulfate.

As necessary, a colorant, wax or an electrostatic charge-controlling agent may be in incorporated to the toner of the present invention.

Colorant:

The toner of the present invention may employ a colorant such as carbon black, a magnetic material, a dye, a pigment and the like. Examples of a carbon black include channel black, furnace black, acetylene black, thermal black and lamp black. Examples of a magnetic material include a ferromagnetic metal of iron, nickel or cobalt or an alloy of these metals and a ferromagnetic metal compound such as ferrite or magnetite.

Examples of a Dye

Dyes include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 112, C.I. Solvent Red 162, C.I. C.I. Solvent Yellow 19, Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93 and C.I. Solvent Blue 95. Examples of a pigment include C.I. Pigment Red 5, C.I. Pigment Red 48:3, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 222, C.I.; C.I. Pigment Orange 31 and C.I. Pigment Orange 43; C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185; C.I. Pigment Green 7, C.I. Pigment Blue 15:3, C.I. Pigment Blue 15:4 and C.I. Pigment Blue 60. These may be used singly or in their combination. The number average primary particle size, which is various, depending on its kind, is generally within a range of 10 to 200 nm.

Wax:

The toner of the present invention may contain a wax. Examples of a wax usable in the present invention include a hydrocarbon wax such as a low molecular weight polyethylene wax, low molecular weight polypropylene wax, Fischer Tropsh wax, microcrystalline wax and paraffin, wax; and ester waxes such as Carnauba wax, pentaerythritol behenate, behenyl behenate and behenyl citrate. These may be used singly or in their combination.

Such a wax is contained preferably in an amount, of 2 to 20% by mass of the total mass of resin particles, more preferably 3 to 18% by mass, and still more preferably 4 to 15% by mass.

The melting point, of a wax is preferably from 50 to 95° C. in terms of low temperature fixability and releasability.

Charge Controlling Agent:

There are usable a variety of compounds as a charge controlling agent constituting charge controlling agent particles which are dispersible in an aqueous medium. Specific examples thereof include a nigrosine dye, a metal salt of napthenic acid or a higher fatty acid, a quaternary ammonium salt compound, an azo metal complex and a metal salt of salicylic acid or its metal complex salt.

Charge controlling agent particles which are dispersed preferably exhibit a number average primary particle size of 10 to 500 nm.

Parent Toner Particle:

Next there will be described parent toner particles used in the present invention. In the present invention, the parent toner particles refer to particles basing a core/shell structure in which a shell layer is provided on the surface of a core particle. Such parent toner particles may be used as toner particles without any change, but it is preferred to add an external additive to the parent toner particles. A toner refers to aggregate of toner particles.

First there will be described the average circularity degree of toner particles used in the present invention. The average circularity degree of toner particles used in the present invention is not less than 0.850 and not more than 0.990.

The average circularity degree can be determined by using FPIA-2100 (produced by Sysmex Co., Ltd.). Specifically, toner particles are blended in an aqueous surfactant solution and dispersed using an ultrasonic homogeniser over 1 min. The measurement condition is set to HPF (high power focusing) mode and the measurement is carried out at an optimum concentration of the HPF detection number of 3000-10000. Reproducible data are obtained in such a range. The circularity degree is defined as below:

Circularity degree=(circumference length of a circle having an area equivalent to a projection of a particle)/(circumference length of a projection of a particle).

The average circularity degree is the sum of circularity degree values of total particles divided by the number of particles.

Particle Size of Toner Particle:

Next, there will be described the particle size of toner particles used in the present invention. The particle size of toner particles used in the present invention, which is represented by a volume-based median diameter ($D_{50}$), is preferably not less than 3 μm and not more than 10 μm. Mien the volume-based median diameter tails within the foregoing range, a minute image, for example, at a level of 1200 dpi (in which dpi is foe number of dots per inch) can be faithfully reproduced.

The volume-based median diameter is measured by Coulter Multisizer 3 (produced by Beckman Coulter Corp.) connected to a computer system for data processing. Specifically, 0.02 g of toner particles is treated with a 20 ml surfactant solution (in which a neutral detergent containing a surfactant component is diluted 10 times with pure water) and then subjected to ultrasonic dispersion for 1 min. to prepare foe toner dispersion. The toner dispersion is introduced by a pipette into a beaker containing ISOTON II (produced by Beckman Coulter Corp.), and placed in a sample stand until it reaches a measured concentration of 5 to 10%. Such a concentration makes it feasible to obtain reproducible measurement values. The analyzer count is set to 25000 particles and an aperture diameter of 100 μm was used. A measurement range of 1 to 30 μm is divided to 256 parts and the frequency of an individual part is calculated and the particle diameter at 50% of volume fraction integrated from the larger side (also denoted volume D 50% diameter) is defined as foe volume-based median diameter.

The softening point of the toner of the present invention is preferably within the range of 90 to 115° C. When the softening point of a toner falls within the foregoing range, preferable low temperature fixability can be achieved. The softening point of a toner can be determined by Flow Tester CFT-500D (made by Shimazu Seisakusho).

Production Method of Parent Toner Particle:

In the present invention, parent toner particles are obtained by using a binder and a colorant or internal additives such as wax as necessary, and an external additive is added to the parent toner particles to prepare a toner.

There will be described a production method of parent toner particles usable in the present invention.

Parent toner particles used in the invention comprise at least a binder resin and a colorant, constitute a parent material of toner particles for use in electrophotographic image formation, and are generally called parent particles or colored particles.

Methods of preparing parent toner particles of the present invention include, for example, a suspension polymerization method, an emulsion aggregation method and other known methods, of which the emulsion aggregation method is preferably employed. Such, an emulsion aggregation method can easily achieve downsizing of toner particles in terms of production cost and production stability.

In the emulsion aggregation method, a dispersion of particles of a binder resin (hereinafter, also denoted as binder resin particles) is optionally mixed with a dispersion of particles of a colorant (hereinafter, also denoted as colorant particles), then, these particles are allowed to aggregate and fusion between binder resin particles is further performed to control the particle form, whereby toner particles are produced. Herein, the binder resin particles may optionally contain a releasing agent or a charge-controlling agent.

There is shown below an example of a production method of a toner by using an emulsion aggregation method. The method comprises the steps, as shown below:

(1) preparation of a dispersion of colorant particles dispersed in an aqueous medium,
(2) preparation of a dispersion of binder resin particles which optionally contain a colorant and are dispersed in an aqueous medium,
(3) mixing the dispersion of colorant particles and the dispersion of binder resin particles and allowing the colorant particles and the binder resin particles to aggregate and fuse to form toner particles,
(4) filtering off the toner particles from, a toner particle dispersion (aqueous medium) to remove a surfactant or the like,
(5) drying foe toner particles, and
(6) adding external additives to the toner particles.

In the foregoing step (2), it is preferred to employ a dispersion of emulsion polymerization particles obtained by emulsion polymerization, as a technique of dispersing a binder resin. The binder resin particles may have a multi-layer structure constituted of two or more layers differing in composition. Binder resin particles of such a constitution, for example, those of a two-layer structure are obtained in such a manner that a dispersion of resin particles is prepared by an emulsion polymerization treatment (first polymerization step) according to any conventional method, then, a polymerization initiator and a polymerizable monomer are added to the dispersion, which is further subjected to a polymerization treatment (second polymerization step).

Toner particles having a core/shell structure can also be obtained through an emulsion aggregation method. More specifically, first, binder resin particles used for a core and colorant, particles are allowed to aggregate and fuse to form core particles. Subsequently, binder resin particles used for a shell layer are added to the dispersion of the core particles and allowed to aggregate and fuse on the surfaces of the core particles to form a shell layer covering the core particle surface, whereby toner particles of a core/shell structure are obtained.

Production Method of Core Particle:

Core particles can be produced by commonly known methods, and an emulsion aggregation process is preferably employed in which resin particles and colorant particles are dispersed in art aqueous medium and allowed to aggregate to form core particles.

When core particles are formed by allowing resin particles composed of a styrene-acrylic resin to aggregate and fuse, such core particles are usually formed by an emulsion aggregation process. In such an emulsion aggregation process, resin particles which have been prepared by polymerizing a polymerizable monomer emulsified in an aqueous medium, and colorant particles are allowed to aggregate and fuse in an aqueous medium together with optional additives, for example, an offset inhibitor such as wax, a charge control agent and magnetic powder to form core particles. Alternatively, a polymerizable monomer is subjected, in an aqueous medium, to seed emulsion polymerization in the presence of an offset inhibitor or a charge control agent. The weight average particle size of resin particles is preferably within, the range of 50 to 500 nm.

Formation Method of Shell Layer:

It is preferred to apply an emulsion aggregation process to form a uniform shell layer on the core particle surface. In such an emulsion aggregation process, an emulsion dispersion of shell particles is added to an aqueous dispersion of core particles and the shell particles are allowed to aggregate and fuse to form a shell layer on the core particle surface.

The toner particles of the present invention are obtained preferably by a process of mixing a dispersion of colorant particles dispersed an aqueous medium and a dispersion of binder resin particles dispersed in an aqueous medium, and allowing the colorant particles and the binder resin particles to aggregate and fuse, that is, by an emulsion aggregation process.

In the present invention, the aqueous medium refers to a medium comprised of 50 to 100% by mass of water and 0 to 50% by mass of a water-soluble organic solvent. Examples of such a water-soluble organic solvent include methanol, ethanol, isopropanol, butanol, acetone, methyl ethyl ketone, and tetrahydrofuran, and an alcoholic organic solvent which does not dissolve the obtained resin, is preferable.

Surfactant:

A dispersion stabilizer is usually added to an aqueous medium to prevent dispersed droplets from flocculation. Such a dispersion stabilizer can use commonly known surfactants and there is usable a dispersion stabilizer selected from a cationic surfactant, an anionic surfactant and a nonionic surfactant. These surfactants may be used in combination. Further, a dispersion stabilizer may also be used in a colorant or in an offset inhibitor.

Specific examples of a cationic surfactant include dodecylammonium bromide, dodecyltrimethylammonium bromide, dodecylpyridinium chloride, dodecylpyridinium bromide, and hexadecyltrimethylammonium bromide.

Specific examples of a nonionic surfactant include polyoxyethylene dodecyl ether, polyoxyethylene hexadecyl ether, polyoxyethylene nonylphenyl ether, polyoxyethylene lauryl ether, polyoxyethylene sorbitan-monooleate ether, polyoxyethylene styrylphenyl ether and monodecanoyl sacrose.

Specific examples of an anionic surfactant include sodium stearate, sodium dodecylbenzenesulfonate, and polyoxyethylene (2) lauryl ether sodium sulfate.

Dispersion of Colorant:

A colorant dispersion can be prepared by dispersing colorant particles in an aqueous medium. A dispersing treatment of a colorant is conducted preferably at a surfactant concentration higher than the critical micelle concentration in an aqueous medium, whereby the colorant is homogeneously dispersed. A dispersing machine for use in a dispersing treatment of a colorant may employ any commonly known ones. A surfactant usable in the invention may employ commonly known one.

In the foregoing step (1) of preparing a colorant dispersion, the colorant particle size is preferably 10 to 300 nm in terms of volume-based median diameter.

Measurement of Colorant Particle Size:

The particle size of colorant particles dispersed in an aqueous medium is represented by a volume average particle size, that is, a volume-based median diameter. This median diameter is a value measured by using a micro-track particle size measurement device (UPA-150, made by Nikkiso Co., Ltd.).

Measurement Condition:

(1) Refractive index of sample: 1.59

(2) Specific gravity of sample: 1.05 (equivalent sphere diameter)

(3) Refractive index of sample: 0.797 at 30° C.

(4) Viscosity of solvent: 0.797 at 30° C.
1.002 at 20° C.

Deionized water is placed into a measurement cell and a zero adjustment is made, then, measurement is carried out.

Aggregation/Fusion Step:

Next, there will be described a step of allowing colorant particles and binder resin particles to aggregate and fuse in an emulsion aggregation process.

In the aggregation step, an aqueous dispersion of resin particles is mixed with a dispersion of colorant particles, and optionally, wax particles, charge control agent particles or other toner constituent particles to prepare a dispersion for use in aggregation, which is subjected to aggregation/fusion to form a dispersion of colored particles.

A flocculant usable in the present invention is not specifically limited but one selected from metal salts is more suitable. Such metal salts include, for example, a salt of a monovalent metal such as alkali metal such as sodium, potassium or lithium; a salt of a divalent metal such as calcium, magnesium, manganese or copper and a salt of a trivalent metal such as iron or aluminum. Specific examples of a salt include sodium chloride, potassium chloride, lithium chloride, calcium chloride, manganese chloride, zinc chloride, copper sulfate, magnesium sulfate and manganese sulfate. Of these salts, a divalent metal salt is preferred. Aggregation is achieved by use of a small amount of a divalent metal salt. These salts may be used singly or in their combination.

In the aggregation step, it is preferred to shorten the standing time after addition of a flocculant (that is, an interval until start of heating). Namely, after adding a flocculant, it is preferred to start heating a dispersion to be subjected to aggregation as promptly as possible and heat it to a temperature higher than the glass transition, point of the resin composition. The reason thereof is not clear but the aggregation state of particles varies with a standing time, there is a concern that the panicle size distribution of the obtained toner particles becomes unstable or the surface property varies. The standing time is usually within 30 minutes and preferably not more than 10 minutes.

In the aggregation step, it is preferred to raise the temperature by heating as promptly as possible and the temperature rise rate is preferably not less than 1° C./min. The upper limit of the temperature rise rate is not specifically limited but a rate of not more than 15°/min is preferable in terms of inhibition of generation of coarse particles. Thereby, growth of colored particles and fusion proceeds effectively, rendering it feasible to achieve enhanced durability of finally obtained particles.

External Additive:

In the present invention, there may be added an external additive to improve fluidity or electrostatic charge characteristic of toner particles.

Specific examples of an external additive usable in the present invention include inorganic oxide particles such as silica particles, alumina particles or titanium oxide particles; inorganic stearate compound particles such as aluminum stearate particles or zinc stearate particles; and inorganic titanate compound particles such as strontium titanate or zinc titanate.

These inorganic particles which have been subjected to surface modification with a silane coupling agent, a titanium coupling agent, a higher fatty acid, a silicone oil or the like, are preferred in terms of heat storage stability and environmental stability.

An external additive is added preferably in an amount of 0.05 to 5 parts by mass per 100 parts by mass of parent toner particles, and more preferably 0.1 to 3 parts by mass. External additives may be used in their combination.

Addition methods of an external additive include a dry process in which an external additive in a powdery form is added to dried parent toner particles by using a mechanical mixing device such as a Henschell mixer.

Developer:

The toner of the present invention is usable as a two-component developer constituted of a carrier and a toner or as a non-magnetic single component developer.

A carrier of magnetic particles used in a two-component developer can employ conventionally known materials, for example, a metal such as iron, ferrite or magnetite, an alloy of the foregoing metal and a metal of aluminum or lead. Of these, ferrite particles are preferred. There may be used a coated carrier in which the surfaces of magnetic particles are covered with a covering agent such as a resin or a resin dispersion type carrier in which a fine powdery magnetic material is dispersed in a binder resin. The volume average particle size of a carrier preferably is 15 to 100 μm, and more preferably 25 to 80 μm.

Image Forming Apparatus:

An image forming apparatus in which the toner of the present invention is usable is provided, on an electrostatic latent image carrier (which is typically an electrophotographic photoreceptor and hereinafter, also denoted as a photoreceptor), with a charging means, an exposure means, a developing means by a developer including a toner and a transfer means to transfer a toner image formed by the developing means to a transfer material through an intermediate transfer body. Specifically, the toner of the present invention is effectively used in a color image forming apparatus in which toner images on a photoreceptor are sequentially transferred to an intermediate transfer body or a tandem type color image forming apparatus in which plural photoreceptors for the individual colors are disposed in series on an intermediate transfer material.

EXAMPLES

The embodiments of the present invention will be further described with reference to examples, but the invention is by no means limited to these. In Examples, unless otherwise noted, "part(s)" and "%" represent part(s) by mass and % by mass, respectively.

A toner of the present invention was prepared in the manner described below:

(1) Synthesis of styrene-acrylic modified polyester resin (B), (2) Preparation of styrene-acrylic modified polyester resin dispersion [B], (3) Preparation of resin particle dispersion [A] for core, (4) Preparation, of colorant particle dispersion (1), and (5) Aggregation/fusion and external additive treatment.

In the following, the foregoing procedure will be described sequentially.

(1) Synthesis of Styrene-Acrylic Modified Polyester Resin (B):

Synthesis of Styrene-Acrylic Modified Polyester Resin (B1):

Into a four-necked flask fitted with a nitrogen-introducing tubs, a dehydration tube, a stirrer and a thermocouple was added the following mixture and polycondensation reaction was carried out at 230° C. over 8 hours.

| | |
|---|---|
| Bisphenol A propylene oxide 2 mol adduct | 500 parts by mass |
| Terephthalic acid | 117 parts by mass |
| Fumaric acid | 82 parts by mass |
| Esterification catalyst (tin octylate) | 2 parts by mass |

After the reaction was further continued under a pressure of 8 kPa, the reaction mixture was cooled to 160° C. Further thereto, the following mixture was dropwise added through a dropping funnel over 1 hour.

| | |
|---|---|
| Acrylic acid | 10 parts by mass |
| Styrene | 30 parts by mass |
| Butyl acrylate | 7 parts by mass |
| Polymerization initiator (di-t-butyl peroxide) | 10 parts |

After addition, the reaction mixture was maintained at 160° C. over 1 hour to continue the addition polymerization reaction, the temperature was raised to 200° C. and after maintained over 1 hour under a pressure of 10 kPa, the remainder of acrylic acid, styrene and butyl acrylate was removed to obtain a styrene-acrylic modified polyester resin (B1). The thus obtained styrene-acrylic modified polyester resin (B1) exhibited a glass transition point of 60° C. and a softening point of 105° C.

Synthesis of Styrene-Acrylic Modified Polyester Resins (B2) (B10);

Styrene-acrylic modified polyester resins (B2) to (B10) were prepared in the same manner as the foregoing synthesis of styrene-acrylic modified polyester resin (B1), except that the constitution of monomers was varied, as shown in Table 1.

Synthesis of Styrene-Acrylic Modified Polyester Resins (B11):

A polyester resin (a) was synthesized as follows. A mixture of 360 parts by mass of bisphenol A of propylene oxide 2 mol adduct 80 parts by mass of terephthalic acid, 55 parts by mass of fumaric acid and 2 parts by mass of titanium tetraisopropoxide was divided into 10 parts and added into a reaction vessel equipped with a condenser, a stirrer and a nitrogen introducing tube acid was reacted at 200° C. over 10 hours under a nitrogen gas stream, while removing resulting water. Subsequently, the reaction was undergone under a reduced pressure of 13.3 kPa (100 mmHg) and when the softening point reached 104° C., the reaction product was taken out, which was denoted as polyester (a). The thus prepared polyester (a) exhibited a Tg of 65° C., a number average molecular weight of 4500, and a weight average molecular weight of 13500.

Styrene-acrylic modified polyester resins (B11) was synthesized as follows. Into a reaction vessel equipped with a condenser, a stirrer and a nitrogen introducing tube were placed 430 g of xylene and the foregoing synthesized polyester resin (a) and dissolved. After replacing the inside of the reaction vessel with nitrogen, a mixture of 100 parts by mass of styrene, 24 parts by mass of 2-ethylhexyl acrylate, 0.88 part by mass of di-t-butyl peroxide and 100 parts by mass of xylene was dropwise added at 170° C. over 3 tours to perform polymerization and this temperature was further maintained over 30 minutes. Subsequently, solvent removal was conducted to obtain styrene-acrylic modified polyester resin (B11).

Synthesis of Styrene-Acrylic Modified Polyester Resins (B12);

Styrene-acrylic modified polyester resins (B12) was synthesized in the same manner as the foregoing styrene-acrylic modified polyester resins (B1), except that acrylic acid, styrene, butyl acrylate and a polymerization initiator were not added.

(2) Preparation of Styrene-Acrylic Modified Polyester Resin (B) Dispersion;

Preparation of Dispersion of Styrene-Acrylic Modified Polyester Resin (B1):

In Randel Mill (type RM, produced by Tokuju Kosakusho Co., Ltd.) was ground 100 parts by mass of the obtained styrene-acrylic modified polyester resin (B1) and mixed with 638 parts by mass of 638 parts by mass of a 0.26% by mass sodium laurylsulfate solution which had been previously prepared. The mixture was dispersed in a ultrasonic homogenizer (US-150T, produced by Nippon Seiki Seisakusho) at V-LEVEL and 300 μA over 30 minutes to prepare a dispersion of styrene-acrylic modified polyester resin particles (B1).

Preparation of Styrene-Acrylic Modified Polyester Resin Particle Dispersion [B2]-[B11]:

Each of styrene-acrylic modified, polyester resin dispersions [B2]-[B11] was prepared in the same manner as the foregoing particulate styrene-acrylic modified polyester resin dispersion [B1], except that the styrene-acrylic modified polyester resin (B1) used in preparation of the particulate styrene-acrylic modified polyester resin dispersion [B1] was replaced by each, of styrene-acrylic modified polyester resins (B2)-(B11).

Preparation of Unmodified Polyester Resin Dispersion [B12]:

Unmodified polyester resin dispersion [B12] was prepared in the same manner as the foregoing particulate styrene-acrylic modified polyester resin dispersion [B1], except that the styrene-acrylic modified polyester resin (B1) used in preparation of the particulate styrene-acrylic modified polyester resin dispersion [B1] was replaced by unmodified polyester resin (B12).

Synthesis of Styrene-Acrylic Modified Polyester Resins (B13):

A polyester resin (b) was synthesized as follows. A mixture of 500 parts by mass of bisphenol A of propylene oxide 2 mol adduct, 117 parts by mass of terephthalic acid, 82 parts by mass of maleic acid and 2 parts by mass of titanium tetraisopropoxide was divided into 10 parts and added into a reaction vessel equipped with a condenser, a stirrer and a nitrogen inn-educing tube and was reacted at 200° C. over 10 hours under a nitrogen gas stream, while removing resulting water. Subsequently, the reaction was undergone under a reduced pressure of 133 kPa (100 mmHg) and when the softening point reached 104° C. the reaction product was taken out, which was denoted as polyester (a). The thus prepared polyester (b) exhibited a Tg of 60° C., a number average molecular weight of 5000, and a weight average molecular weight of 13000.

Styrene-acrylic modified polyester resins (B13) was synthesized as follows. Into a reaction vessel equipped with a condenser, a stirrer and a nitrogen introducing tube were placed 430 g of xylene and the foregoing synthesized polyester resin (b) and dissolved. After replacing the inside of the reaction vessel with nitrogen, a mixture of 78 parts by mass of 2-ethylhexyl acrylate, 0.88 part by mass of di-t-butyl peroxide and 100 parts by mass of xylene was dropwise added at 170° C. over 3 hours to perform polymerization and tills temperature was further maintained over 30 minutes. Subsequently, solvent removal was conducted to obtain styrene-acrylic modified polyester resin (B13). The thus obtained styrene-acrylic modified polyester resin (B13) exhibited a glass transition point (Tg) of 63° C. and a softening point of 109° C.

TABLE 1

| Styrene-Acrylic modified Polyester Resin | Polyvalent Alcohol Monomer: Bisphenol A Propylene Oxide (part/mol) | Polyvalent Carboxylic Acid Monomer: Saturated Dicarboxylic Acid: Terephthalic Acid (part) | Unsaturated Dicarboxylic Acid: Fumaric Acid (part) | Unsaturated Dicarboxylic Acid: Maleic Acid (part) | Unsaturated Dicarboxylic Acid Content (mol %) | Direactive Monomer: Acrylic Acid (part) | Aromatic Vinyl Monomer: Styrene (part) | Acrylate Monomer: Butyl Acrylate (part) | Acrylate Monomer: 2-Ethylhexyl Acrylate (part) | Styrene-acrylic Modification Amount (%) |
|---|---|---|---|---|---|---|---|---|---|---|
| [B1] | 500/1.45 | 117 | 82 | — | 50 | 10 | 30 | 7 | — | 5 |
| [B2] | 500/1.45 | 117 | 82 | — | 50 | 10 | 63 | 16 | — | 10 |
| [B3] | 500/1.45 | 117 | 82 | — | 50 | 10 | 142 | 35 | — | 20 |
| [B4] | 500/1.45 | 117 | 82 | — | 50 | 10 | 243 | 61 | — | 30 |
| [B5] | 500/1.45 | 117 | 82 | — | 50 | 10 | 15 | 4 | — | 2.6 |
| [B6] | 500/1.45 | 117 | 82 | — | 50 | 10 | 305 | 76 | — | 35 |
| [B7] | 500/1.45 | 175 | 41 | — | 25 | 10 | 145 | 36 | — | 20 |
| [B8] | 500/1.45 | 58 | 122 | — | 75 | 10 | 138 | 35 | — | 20 |
| [B9] | 500/1.45 | 175 | 35 | — | 22 | 10 | 150 | 36 | — | 20 |
| [B10] | 500/1.45 | 55 | 130 | — | 77 | 10 | 138 | 36 | — | 20 |
| [B11] | 360/1.45 | 80 | 55 | — | 50 | — | 100 | — | 24 | 20 |
| [B12] | 500/1.45 | 117 | 82 | — | 50 | — | — | — | — | 0 |
| [B13] | 500/1.45 | 117 | — | 82 | 50 | — | — | — | 78 | 10 |

(3) Preparation of Dispersion [A] of Resin Particles for Core;

(3-1) First Polymerization Step:

Into a reactor vessel equipped with a stirrer, a temperature sensor, a temperature controller, a condenser tubs and a nitrogen, introducing device was placed an anionic surfactant solution in which 2.0 parts by mass of an anionic surfactant of sodium laurylsulfate was dissolved in 2,900 parts by mass and the internal temperature was raised to 80° C., while stirring at 230 rpm under a nitrogen stream.

To this surfactant solution was added 9.0 parts by mass of a polymerization initiator (potassium persulfate or denoted simply as KPS) and after the internal temperature was controlled, to 78° C., a monomer solution (1) described below was dropwise added thereto over 3 hours.

Monomer Solution (1):

| | |
|---|---|
| Styrene | 540 parts by mass |
| n-Butyl acrylate | 270 parts by mass |
| Methacrylic acid | 65 parts by mass |
| n-Octylmercaptan | 17 parts by mass |

After completion of addition, hearing and stirring continued at 78° C. over 1 hour to perform polymerization (first polymerization step), whereby a dispersion of resin particles (al) was prepared, (3-2) Second Polymerization Step:

There was formed an intermediate layer as follows. Into a flask fitted with a stirrer was added a mixture, as described below;

| | |
|---|---|
| Styrene | 94 parts by mass |
| n-Butyl acrylate | 60 parts by mass |
| Methacrylic acid | 11 parts by mass |
| n-Octylmercaptan | 5 parts by mass |

Further thereto, 51 parts by mass of paraffin wax (melting point: 73° C.) was added and dissolved with heating to 85° C. to prepare a monomer solution (2).

On the other hand, a surfactant solution in which 2 parts by mass of an anionic surfactant (sodium laurylsulfate) was dissolved in 100 parts by mass of deionized water, was heated to 90° C. and further thereto, 28 parts by mass of the foregoing dispersion of resin particles (al) was added in an amount of 28 parts by mass in terms of solids. Then, the foregoing monomer solution (2) was added thereto and mixed in a mechanical dispenser provided with a circulation path (CREAMIX, produced by M-Technique Co., Ltd.) over 4 hours to prepare a dispersion containing emulsified particle having a dispersion particle size of 350 nm. To this dispersion was added an aqueous initiator solution in which 2.5 parts by mass of a polymerization initiator (KPS) was dissolved in 110 parts by mass of deionized water and the mixture was heated at 90° C. with stirring to perform polymerization (second polymerization step), whereby a dispersion of resin particles (a11) was prepared, in which an intermediate layer of a core particle was formed.

(3-3) Third Polymerization Step:

To the foregoing dispersion of resin particles (al 1) was an aqueous initiator solution in which 2.5 g of a polymerization initiator (KPS) was dissolved in 110 parts by mass of deionized water and further thereto, a monomer solution (3) described below was dropwise added over 1 hour, while stirring with healing at 80° C.

Monomer Solution (3)

| | |
|---|---|
| Styrene | 230 parts by mass |
| n-Butyl acrylate | 100 parts by mass |
| n-Octylmercaptan | 5.2 parts by mass |

After completing addition, stirring and heating continued over 3 hours to perform polymerization (third polymerization step) to form an outer layer of a core particle. Thereafter, the reaction mixture was cooled to 28° C. to prepare a resin particle dispersion (A) used for a core in which resin particles (A) for a core, containing a styrene-acrylic resin were dispersed in an aqueous anionic surfactant solution, (4) Preparation of Colorant Particle Dispersion:

In 1600 parts by mass of deionized water was dissolved 90 parts by mass of sodium dodecylsulfate, while stirring. To this solution was added 420 parts by mass of carbon black (MOGAL L, produced by Cabot Corp.) and dispersed in a mechanical dispenser (CREAMIX, produced by M-Technique Co., Ltd.) to prepare a colorant dispersion (1) in which colorant particles were dispersed. The colorant particle size of this dispersion was 117 ran, which was determined by using a micro-hack particle size distribution measuring instrument (UPA-150, made by Nikkiso Co., Ltd.).

(5) Aggregation/Fusion and External Additive Treatment:

(5-1) Preparation of Toner 1:

Aggregation/Fusion Step:

Into a reaction vessel fitted with a stirrer, a temperature sensor and a condenser tube were added the foregoing resin particle dispersion (A) for a core of 288 parts by mass in terms of solids, styrene-acrylic modified, polyester resin particle dispersion (B3) of 15.2 parts by mass in terms of solids and deionized water of 2000 parts by mass, and then the pH was adjusted to 10 with an aqueous 5 mol/L sodium hydroxide solution.

Subsequently, a colorant dispersion (1) was added thereto in an amount of 40 parts by mass in terms of solids. Further, an aqueous solution in which 60 parts by mass of magnesium chloride was dissolved in 60 parts by mass of deionized water, was added thereto at 30° C. over 10 minutes. After the mixture was allowed to stand over 3 minutes, the temperature was raised 80° C. over 60 minutes and particle growth was continued, while maintaining the temperature at 80° C. and measuring the particle size of aggregated particles by Multisizer 3 (made by Beckman Coulter Corp.). When the volume-based median diameter of aggregated particles reached 6.0 μm, styrene-acrylic modified polyester resin particle dispersion (B3) was added in an amount of 75.8 parts by mass in terms of solids over 30 minutes. When the supernatant of the reaction mixture became clear, an aqueous solution in which 190 parts by mass of sodium chloride was dissolved in 760 parts by mass of deionized water, was added thereto to terminate the particle growth. The temperature was further raised to 90° C. with stirring was conducted to allow the fusion of the particles to proceed and when the average circularity of toner particles reached 0.945 by using an instrument, FPIA-2100 (made by Sysmex Corp.), the reaction mixture was cooled to 30° C. to obtain a parent toner particle dispersion 1.

Washing/Drying Step:

The thus prepared parent, toner particles (parent toner particle dispersion 1) were subjected to solid/liquid separation by using a centrifugal, separator to form a wet cake of parent toner particles. The wet cake was washed with 35° C. deionized water and subjected to centrifugal separation until the electric conductivity of the filtrate readied 5 μS/cm, and then transferred to Flush Jet Dryer (made by Seishin Kigyo Co., Ltd.) and dried until the moisture content reached 0.5% by mass, whereby parent toner particles (1) were prepared.

External Additive Treatment Step:

To the parent toner particles (1) were added a hydrophobic silica (number average primary particle size: 12 nm) and hydrophobic titania (number average primary particle size: 20 ran) in amounts of 1% by mass and 0.3% by mass, respectively, and mixed in a Henschell mixer to obtain Toner 1.

Preparation of Toners 2-28:

Toners 2-28 were each prepared in the same manner as the foregoing toner 1, except that a resin particle dispersion for core and a resin particle dispersion for shell were changed with respect to kind and amount thereof, as shown in Table 2. In Table 2, Toners 1-25 are those according to foe present invention, and Toners 26-28 are those for comparison.

TABLE 2

| | Core | | | | | | | Shell | | | |
|---|---|---|---|---|---|---|---|---|---|---|---|
| | | | Styrene-Acrylic Modified Polyester Resin | | | | Core Resin | Styrene-Acrylic Modified Polyester Resin | | | Shell Resin |
| Toner | *1 | | | | Unsaturated Dicarboxylic Acid Monomer Amount | | Content of Toner Particle | | | Unsaturated Dicarboxylic Acid Monomer Amount | Content of Toner Particle |
| No. | Resin | *2 | Resin | *3 | (mol %) | *4 | (part) | Kind | *5 | (mol %) | (part) |
| 1 | A | 95 | B3 | 20 | 0.50 | 5 | 80 | B3 | 20 | 0.50 | 20 |
| 2 | A | 90 | B3 | 20 | 0.50 | 10 | 80 | B3 | 20 | 0.50 | 20 |
| 3 | A | 80 | B3 | 20 | 0.50 | 20 | 80 | B3 | 20 | 0.50 | 20 |
| 4 | A | 80 | B3 | 20 | 0.5 | 20 | 80 | B3 | 20 | 0.50 | 20 |
| 5 | A | 80 | B7 | 20 | 0.25 | 20 | 80 | B3 | 20 | 0.50 | 20 |
| 6 | A | 80 | B8 | 20 | 0.75 | 20 | 80 | B3 | 20 | 0.50 | 20 |
| 7 | A | 80 | B9 | 20 | 0.22 | 20 | 80 | B3 | 20 | 0.50 | 20 |
| 8 | A | 80 | B10 | 20 | 0.77 | 20 | 80 | B3 | 20 | 0.50 | 20 |
| 9 | A | 70 | B3 | 20 | 0.50 | 30 | 80 | B3 | 20 | 0.50 | 20 |
| 10 | A | 65 | B3 | 20 | 0.50 | 35 | 80 | B3 | 20 | 0.50 | 20 |
| 11 | A | 80 | B5 | 2.5 | 0.50 | 20 | 80 | B3 | 20 | 0.50 | 20 |
| 12 | A | 80 | B1 | 5 | 0.50 | 20 | 80 | B3 | 20 | 0.50 | 20 |
| 13 | A | 80 | B2 | 10 | 0.50 | 20 | 80 | B3 | 20 | 0.50 | 20 |
| 14 | A | 80 | B3 | 20 | 0.50 | 20 | 80 | B3 | 20 | 0.50 | 20 |
| 15 | A | 80 | B4 | 30 | 0.50 | 20 | 80 | B3 | 20 | 0.50 | 20 |
| 16 | A | 80 | B6 | 35 | 0.50 | 20 | 80 | B3 | 20 | 0.50 | 20 |
| 17 | A | 80 | B3 | 20 | 0.50 | 20 | 80 | B5 | 2.5 | 0.50 | 20 |
| 18 | A | 80 | B3 | 20 | 0.50 | 20 | 80 | B1 | 5 | 0.50 | 20 |
| 19 | A | 80 | B3 | 20 | 0.50 | 20 | 80 | B2 | 10 | 0.50 | 20 |
| 20 | A | 80 | B3 | 20 | 0.50 | 20 | 80 | B3 | 20 | 0.50 | 20 |
| 21 | A | 80 | B3 | 20 | 0.50 | 20 | 80 | B4 | 30 | 0.50 | 20 |
| 22 | A | 80 | B3 | 20 | 0.50 | 20 | 80 | B6 | 35 | 0.50 | 20 |
| 23 | A | 80 | B11 | 20 | 0.50 | 20 | 80 | B3 | 20 | 0.50 | 20 |
| 24 | A | 80 | B3 | 20 | 0.50 | 20 | 80 | B11 | 20 | 0.50 | 20 |
| 25 | A | 80 | B11 | 20 | 0.50 | 20 | 80 | B11 | 20 | 0.50 | 20 |
| 26 | A | 100 | — | — | — | 0 | 80 | B3 | 20 | — | 20 |

TABLE 2-continued

| Toner | Core | | | | | | | Shell | | | |
|---|---|---|---|---|---|---|---|---|---|---|---|
| | | | Styrene-Acrylic Modified Polyester Resin | | | | Core Resin | Styrene-Acrylic Modified Polyester Resin | | | Shell Resin |
| | *1 | | | | Unsaturated Dicarboxylic Acid Monomer Amount | | Content of Toner Particle | | | Unsaturated Dicarboxylic Acid Monomer Amount | Content of Toner Particle |
| No. | Resin | *2 | Resin | *3 | (mol %) | *4 | (part) | Kind | *5 | (mol %) | (part) |
| 27 | A | 80 | B3 | 20 | 0.50 | 20 | 80 | B12 | 0 | — | 20 |
| 23 | A | 80 | B13 | 10 | 0.50 | 20 | 80 | B13 | 10 | 0.50 | 20 |

*1: Styrene-Acryl Resin,
*2: Content (%)
*3: Content in core binder resin (part)
*4: Content in core resin (part)
*5: Content (%)

Preparation of Developer:

Into a high-speed mixer equipped with a stirring blade were placed 100 pasts by mass of a ferrite core and 5 pans by mass of copolymer resin particles of cyclohexyl methacrylate/methyl methacrylate and mixed with stirring at 120° C. over 30 min. to form a resin coating layer on the ferrite surface by the action of mechanical impact force, whereby a carrier of a volume-based median diameter of 50 μm was obtained. The volume-based median diameter of a carrier was measured by a laser diffraction sensor HELOS (made by SYMPATECS Co., Ltd.) which was installed with a wet dispenser.

Each of toners 1 to 21 was added to the foregoing carrier so that the toner concentration was 6% by mass, and the mixture was placed into a micro type V-shaped mixer (made by Tsutsui Rikagakuki Co., Ltd.) and mixed at a rotation rate of 45 rpm over 30 minutes to prepare a developer.

Evaluation:

(1) Low Temperature Fixing Characteristic:

Each of the foregoing developers was loaded into a developing device of a commercially available color copying machine (bizhub PRO G6500, made by Konica Minolta Business Technologies Inc.) and evaluated. The machine was modified so that the fixing temperature, toner adhesion amount and system speed could be freely set. When using, as paper, NPi high quality paper (128 g, produced by Nippon Seishi Co., Ltd.) and fixing a solid image with an adhered toner amount of 11.3 g/m$^2$ at a fixing speed of 300 mm/sec. by setting an upper fixing belt temperature of 150-200° C. and a lower fixing belt temperature lower by 20° C. than the upper fixing belt at a level of every 5° C., evaluation was made with respect to fixing lower limit temperature in which no cold offset occurred. The lower the limit temperature is, the better fixability is. Evaluation was made basal on the following criteria:

A: The lower fixing temperature limit is not more than 150° C.,

B: The lower fixing temperature limit is not more than 165° C.

C: The lower fixing temperature limit is not less than 170° C., (2) Fixing Separability:

When the surface temperature of a heated roller for fixing was set to 180° C. and an A4-size image having a solid image with a 5 an width in the vertical direction to the transport direction is longitudinally transported, separability between the fixing roller (heated roller) of the image side and paper was evaluated basal on the following criteria:

A: Paper separates from the fixing roller without being curled,

B: Paper separates from the fixing roller by a separation claw but almost no trace of the separation claw remains on the image, C: Paper separates from the fixing roller by a separation claw but a trace of the separation claw remains on the image.

D: Paper winds around thea fixing roller and does not separate from the fixing roller.

(3) Electrostatic-Charging Stability:

Printing of 100,000 sheets was conducted under ordinary temperature and ordinary pressure (20° C., 50% RH) in which a sniped solid image as a test image was printed at a print ratio of 5% on fine-quality paper (65 g/m$^2$) of A4 size, an electrostatic charge of a toner was measured at the initial stage of printing and after completion, of printing 100,000 sheets and evaluated based on fixe following criteria. The electrostatic charge was measured by sampling a two-component developer within a developing machine and using a blowoff electrostatic charge meter (TB-200, made by Toshiba Chemical Co., Ltd.).

A: Variation (Δ) of electrostatic charge of a toner between the initial stage of printing and after completion of printing of 100,000 sheets being less than 4 μC/g.

B: Variation (Δ) of electrostatic charge of a toner between the initial stage of printing and after completion of printing of 100,000 sheets being not less than 4 μC/g and less than 6 μC/g.

C: Variation (Δ) of electrostatic charge of a toner between the initial stage of printing and after completion of printing of 100,000 sheets being not less than 6 μC/g and less than 8 μC/g.

D: Variation (Δ) of electrostatic charge of a toner between the initial stage of printing and after completion of printing of 100,000 sheets being not less than 8 μC/g.

The foregoing evaluation results are shown in Table 3.

TABLE 3

| Toner No. | Low Temperature Fixability | Fixing Separability | Electrostatic-Charging Stability | Remark |
|---|---|---|---|---|
| 1 | B | A | A | Inv. |
| 2 | A | A | A | Inv. |
| 3 | A | B | B | Inv. |
| 4 | A | A | A | Inv. |
| 5 | B | A | B | Inv. |
| 6 | B | A | B | Inv. |
| 7 | B | B | B | Inv. |
| 8 | B | B | B | Inv. |

TABLE 3-continued

| Toner No. | Low Temperature Fixability | Fixing Separability | Electrostatic-Charging Stability | Remark |
|---|---|---|---|---|
| 9 | A | B | B | Inv. |
| 10 | A | C | B | Inv. |
| 11 | B | A | B | Inv. |
| 12 | B | A | A | Inv. |
| 13 | A | A | A | Inv. |
| 14 | A | A | A | Inv. |
| 15 | A | B | B | Inv. |
| 16 | B | C | B | Inv. |
| 17 | A | A | C | Inv. |
| 18 | B | A | B | Inv. |
| 19 | B | A | B | Inv. |
| 20 | A | A | A | Inv. |
| 21 | A | B | A | Inv. |
| 22 | A | C | B | Inv. |
| 23 | B | B | B | Inv. |
| 24 | B | B | B | Inv. |
| 25 | B | B | B | Inv. |
| 26 | C | A | B | Comp. |
| 27 | B | B | D | Comp. |
| 28 | B | D | B | Comp. |

As is apparent from the results of Table 3, it was proved that toners according to the present invention were superior in low temperature fixability, fixing separability and electrostatic-charging stability compared to the toner of the comparison, which were inferior in any of the characteristics.

What is claimed is:

1. A toner used for electrostatic latent image development, comprising toner particles, each comprising a core particle and a shell layer provided on the surface of the core particle, wherein the core particle comprises a binder resin containing a styrene-acrylic resin and a first styrene-acrylic modified polyester, and the shell comprises a second styrene-acrylic modified polyester resin.

2. The toner of claim 1, wherein the binder resin of the core particle contains the first styrene-acrylic modified polyester resin in an amount of 5% by mass to 30% by mass.

3. The toner of claim 1, wherein the first styrene-acrylic modified polyester resin or the second styrene-acrylic modified polyester resin contains a styrene-acrylic resin segment of 5% by mass to 30% by mass.

4. The toner of claim 1, wherein the first styrene-acrylic modified polyester resin and the second styrene-acrylic modified polyester resin contain a styrene-acrylic resin segment of 5% by mass to 30% by mass.

5. The toner of claim 1 wherein a structure unit derived from a polyvalent carboxylic acid monomer to form a polyester segment of the styrene-acrylic modified polyester resin contains a structure unit derived from an aliphatic unsaturated dicarboxylic acid of 25 mol % to 75 mol %.

6. The toner of claim 5, wherein the aliphatic unsaturated dicarboxylic acid is represented by the following formula (A):

$$HOOC—(CR_1{=}CR_2)_n—COOH \qquad \text{formula (A)}$$

wherein $R_1$ and $R_2$ are each a hydrogen atom, a methyl group or an ethyl group; and n is an integer of 1 or 2.

7. The toner of claim 1, wherein the first styrene-acrylic modified polyester or the second styrene-acrylic modified polyester is obtained by a process comprising polymerizing an aromatic vinyl monomer and a (meth) acrylate monomer in the presence of an unmodified polyester resin and a di-reactive monomer containing a group capable of reacting with n polyvalent carboxylic acid monomer or a polyvalent alcohol monomer and a polymerizable unsaturated group.

* * * * *